US006694877B1

(12) United States Patent
Wolters et al.

(10) Patent No.: US 6,694,877 B1
(45) Date of Patent: Feb. 24, 2004

(54) DEVICE FOR EXCHANGEABLY SUPPORTING AND POSITIONING PRINTING CYLINDERS OF AN OFFSET PRINTING PRESS

(75) Inventors: Gerrit Wolters, Gorssel (NL); Adelbert Lucas Schoonman, Eerbeek (NL)

(73) Assignee: Drent Holding B.V., Hall (NL)

( * ) Notice: Subject to any disclaimer, the term of this patent is extended or adjusted under 35 U.S.C. 154(b) by 0 days.

(21) Appl. No.: 09/715,305

(22) Filed: Nov. 17, 2000

(30) Foreign Application Priority Data

Nov. 19, 1999 (NL) ..... 1013620

(51) Int. Cl.[7] ..... B41F 7/02
(52) U.S. Cl. ..... 101/218; 101/247
(58) Field of Search ..... 101/266, 218, 101/142, 143, 144, 247, 352, 217, 182, 216

(56) References Cited

U.S. PATENT DOCUMENTS 2,753,797 A 7/1956 Burgmer
3,150,588 A * 9/1964 Bonsch ..... 101/218
3,611,924 A 10/1971 Harrison
4,413,541 A 11/1983 Biggar, III
5,351,616 A 10/1994 Gelinas et al.
5,771,804 A * 6/1998 Knauer et al. ..... 101/183
6,227,111 B1 * 5/2001 Dawley et al. ..... 101/218
6,272,985 B1 * 8/2001 Keller et al. ..... 101/137
6,318,257 B1 * 11/2001 Niemiro et al. ..... 101/212

FOREIGN PATENT DOCUMENTS

FR 1572556 6/1969
GB 2 334 234 8/1999

* cited by examiner

*Primary Examiner*—Ren Yan
(74) *Attorney, Agent, or Firm*—Stroock & Stroock & Lavan LLP

(57) ABSTRACT

The invention relates to a device for use in an offset printing press, for permitting the supporting and positioning of at least the format-dependent printing cylinders of the printing press individually exchangeably therein, in which for positioning of at least the format-depending printing cylinders provision is being made for a system with bearing arms, by means of which these cylinders can be positioned by rotation.

23 Claims, 5 Drawing Sheets

DEVICE FOR EXCHANGEABLY SUPPORTING AND POSITIONING PRINTING CYLINDERS OF AN OFFSET PRINTING PRESS

BACKGROUND OF THE INVENTION

The invention relates to a device for use in an offset printing press for supporting and positioning of printing cylinders of the printing press exchangeably therein.

For the resetting of an offset printing press for variable sizes to another format it is known to exchange a printing assembly or even a format assembly in its entirety per printing tower. Such a format assembly is composed of a housing in which the printing cylinders belonging to a particular format are accommodated in a fixed manner, and in the case of which provision is also made for a gear wheel transmission between the successive printing cylinders, means for enabling the displacement of one or more cylinders axially, and further adjusting means. These format assemblies have to be placed in a printing tower by means of a lift truck, after which the format assembly is fitted in the correct place in the printing tower and is locked therein, which operation can be carried out manually or by means of a pneumatic system fitted in the printing tower.

If a number of different formats have to be available for a printing press with only a minimum number of successive printing towers, it will be clear that already at that stage the number of format assemblies required very soon mounts up. The difference between the format assemblies is substantially the diameter of the format-dependent printing cylinders and that of the corresponding drive gears; the housing and the further adjusting means fitted therein are always virtually the same.

U.S. Pat. No. 3,611,924 shows an offset printing press wherein the image printing cylinder and transfer printing cylinder are changeably supported per se to permit the use of cylinders of different diameters for printing sheets of different length. The transfer printing cylinder is mounted on a pivoted bearing arm that can be rotated toward and away from the image printing cylinder and from an impression printing cylinder. After the transfer printing cylinder has been rotated away, the image printing cylinder can be removed via a horizontal slot. An adjustable eccentric bearing is provided for the transfer printing cylinder to be able to adjust it with respect to the other cylinders.

A disadvantage with this known device is that it is relatively complex and expensive, and that its printing quality leaves to be desired. The adjusting of the eccentric bearing is time-consuming and must be performed each time after a new format of cylinders is placed. It frequently occurs that the transfer printing cylinder lies with different amounts of pressure against both other cylinders, leading to local enlargements or reductions of image dots transferred to the transfer printing cylinder and/or printed on the sheets. Printing on sheets with different thickness, has the same disadvantage of having to adjust the eccentric bearing, and also frequently leads to distortions of printed images. Furthermore, the axes of the several cylinders can not be brought in line with respect to each other for both large and small formats of cylinders. Because of this the supporting means for the cylinders must be relatively strong, and also a deterioration of printed images occurs, for example if small irregularities are present on one of the cylinders. In order to be able to remove the image printing cylinder, a large rotation of the pivoted arm with transfer printing cylinder has to be made. Should only an image carrier plate on the image printing cylinder have to be changed, then this plate is barely accessible.

SUMMARY OF THE INVENTION

The object of the invention is to overcome the above mentioned disadvantages, and more in particular to provide a simple and user friendly device with which only the format-dependent cylinders per se have to be changed while the necessary means for permitting correct positioning of the cylinders relative to each other are accommodated in the printing tower, and with which a good image printing quality can be achieved.

This object is achieved with a device according to claim 1. The device comprises first and second bearing arms with supporting elements for permitting the accommodation in an exchangeable manner of at least two of the printing cylinders, and first and second actuating means for rotating of the first and second bearing arms respectively for positioning the at least two printing cylinders. This ensures that when there is a changeover to a different format only the format-dependent cylinders per se need to be changed. The cylinders are subsequently placed in the correct position relative to each other by the actuating means and bearing arms. Thus, according to the invention, provision is made for at least two of the cylinders to be fitted on or near ends of bearing arms that are rotatable about an axis, the actuating means being able to rotate the bearing arms and supporting elements through a predetermined angle.

The invention has the advantage that the mutual pressures between the cylinders can accurately and easily be adjusted by minor rotations of the bearing arms with respect to each other, making it possible to avoid distortions of images printed. Also different thickness in substrate to be printed is no longer a problem. By means of a suitable mutual adjustment of the positions of the bearing arms it is possible to each time have the cylinders approximately lying in line for different sets of formats. This also leads to an improved image quality, and makes it possible to construct the bearing arms, positioning elements, etc. somewhat less strong. Each of the cylinders is readily accessible, even when only an image plate or a compressible transfer layer has to be changed.

Each of the cylinders supported by a bearing arm is preferably supported by bearing arms placed on both sides, the actuating means preferably also acting upon both bearing arms. This latter situation is preferred, since the cylinders can then not only be positioned always exactly parallel relative to each other, but can also be held securely in that position during operation. Also the actuating means for each bearing arm, preferably can be actuated separately. Thus, for example, one of the bearing arms can be loosened from the cylinder, then be rotated up or downwardly, after which the cylinder can be removed from the other bearing arm by taking it out sideways in the direction of the cylinder axis.

A further development provides for the first actuating means to be rotatably connected to a fixed point and the first bearing arm, and for one or more further actuating means to be rotatably connected to the first bearing arm and a further bearing arm. A possible embodiment of this is to have the first actuating means acting upon a bearing arm of the transfer printing cylinder and two further actuating means acting upon a bearing arm of the transfer printing cylinder and upon a bearing arm of the image printing cylinder and the impression printing cylinder, respectively. The advantage obtained by this is that the positioning of the cylinders is less dependent upon one margin of error.

A possible further variant of this is to place one of the cylinders, for example the image printing cylinder, in a fixed position and to provide the other cylinders on bearing arms co-operating with each other, that is to say the first actuating means actuable relative to a fixed point, while the second actuating means are actuable relative to the rotatable first bearing arm. Thus the construction is very simple. Means for axially moving the image printing cylinder can advantageously be provided onto fixed supporting elements. Furthermore in most offset printing presses inking mechanisms are already adjustably mounted, making it possible for several formats of image printing cylinders to be placed against them.

According to a further development, the means for permitting a bearing arm to rotate through a predetermined angle comprise at least one adjustable distance device. Such an adjustable distance device can act near the end of the bearing arm, where a supporting element for a cylinder may also be situated. However, it is also possible to act upon the bearing arm on the other side of the centre of rotation; this depending on whether it might possibly work out better, on account of the available space in a printing tower.

The adjustable distance device can be, for example, a screw spindle, a hydraulic cylinder or a gear rack system. A screw spindle has the advantage that it is rigid, cheap, and that its position is accurately computable, making it possible to adjust the relative positions of the cylinders based on position of the spindle, instead of based on pressure differences coming from contact between the cylinders. A hydraulic cylinder has the advantage that it is easily protectable against overpressure leading to damages or injuries. In the case of use of a screw spindle with an element to be moved along it, it is possible, for example, to opt for a screw spindle with trapezoidal thread, or a ball circulating spindle, a ball circulating spindle being preferred on account of the low static and dynamic friction. The drive of a screw spindle can be achieved by, for example, an electric motor, a reduction gearbox fitted between the motor and the driven part of the spindle ensuring that the desired torque is supplied and the driven part can always be moved over a minimum distance.

In order to be able to take the printing cylinders into the correct position relative to each other and possibly also relative to the inking rollers, which is preferably carried out by calculating the position and the desired change, a number of values must be known, such as the format of the cylinder and the last position taken up by the supporting elements. It is important here always to know exactly the movement of the driven elements along the spindle.

For this purpose, provision is made according to the invention for a detection device to be connected to the drive for the driven element or to the driven element on the screw spindle, for detection of the angle of rotation of the drive shaft or the driven element on the screw spindle. Measuring or determining the angle of rotation ensures that the movement of the driven element along the spindle is known, and consequently so is the rotation of the bearing arm, and therefore also the new position of a supporting element.

It is possible, instead of the abovementioned detection devices, to provide optical or electromagnetic means to permit detection of the position of a supporting element relative to a scale.

In the case of the device according to the invention, in order to avoid complicated transmission constructions or having to change gear wheels for the changing positions of the printing cylinder for differing formats, provision is made for at least two of the printing cylinders to have their own drive for the purpose of rotation about their own axes. The drives are directly linked to the control system of the printing press, which makes it possible to synchronize the printing cylinders in a printing tower and also successive printing towers with each other in a simple manner.

In principle, it is possible to provide for the drive of the impression cylinder by connecting the latter by means of, for example, a toothed belt transmission to the drive for the rollers of the inking train in the printing press or module thereof. The speed of the drive obtained in this way is sufficiently constant for the impression cylinder.

The supporting elements for the printing cylinders can be composed of cones which are situated on either side of a printing cylinder and by axial displacement can be taken into and out of engagement with a printing cylinder.

However, a through-running mandrel can be used as the supporting element, over which mandrel the cylinder can be pushed and on which it can be clamped by means of a mechanical, electrical or pneumatic clamping device. This has the advantage that the printing cylinders can be taken into and out of the printing tower in the axial direction, and thus at the side of the printing tower, and that manoeuvring between successive printing towers is not necessary. An additional advantage is that the weight of the cylinders can be lower than that of the printing cylinders that have to be wedged between two cones. If light materials are then also used for the manufacture of the printing cylinders, it is even possible to change over the cylinders by hand without aids.

BRIEF DESCRIPTION OF THE DRAWINGS

The device according to the invention is explained further with reference to the exemplary embodiments shown in the drawing, in which.

DETAILED DESCRIPTION OF THE PREFERRED EMBODIMENTS

Figure 1:
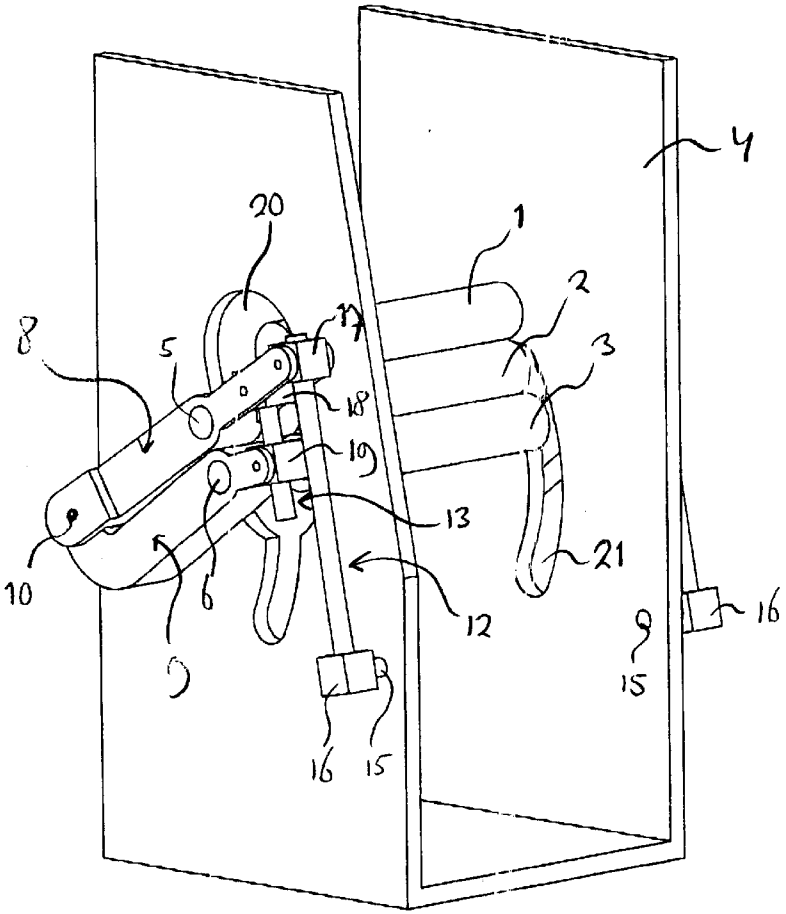
FIG. 1 shows diagrammatically a perspective view of an embodiment of the device according to the invention.

In FIG. 1 the device comprises a printing assembly having three printing cylinders, namely an image printing cylinder 1, a transfer printing cylinder 2 and an impression printing cylinder 3. The image printing cylinder 1 is supported in a fixed position with respect to a U-shaped supporting construction 4. The transfer printing cylinder 2 is supported on both ends between supporting elements 5. The impression printing cylinder 3 is supported on both ends between supporting elements 6. Each supporting element 5 is provided on a first bearing arm 8. Each supporting element 6 is provided on a second bearing arm 9. Each bearing arm 8, 9 is rotatable about an axis 10. The first bearing arm 8 is connected to first actuating means 12 for rotating the bearing arm 8 and supporting element 5 through predetermined angles around the axis 10. The second bearing arm 9 is connected to second actuating means 13 for rotating the bearing arm 9 and supporting element 6 through predetermined angles with respect to the axis 10. In the embodiment shown the second actuating means 13 are connected to the first bearing arm 8, causing the second actuating means 13 to move along with a rotation of the first bearing arm 8 if the first actuating means 12 are actuated.

Both the first and second actuating means 12, 13 comprise an adjustable distance device, which in the embodiment shown is formed by a screw spindle. The component parts of the screw spindle of the first actuating means 12 are pivotably connected to the bearing arm 8 and to a fixed point 15 on the supporting construction 4. A drive 16 is provided for accurately rotating the screw spindle, resulting in an upward or downward movement of a nut element 17 connected pivotably to the first bearing arm 8. Component parts of the second actuating means 13 comprise a drive 18 pivotably connected to the first bearing arm 8 for driving the screw spindle, resulting in an upward or downward movement of a nut element 19 pivotably connected to the second bearing arm 9. The side walls of the supporting construction 4 are each provided with openings 20, 21. The openings 20, 21 make it possible for the bearing arms 8, 9 to shift the supporting elements 5, 6 mounted thereon, together with the printing cylinders 2, 3 supported between them, to other desired positions with respect to the image printing cylinder 1.

Figure 2:
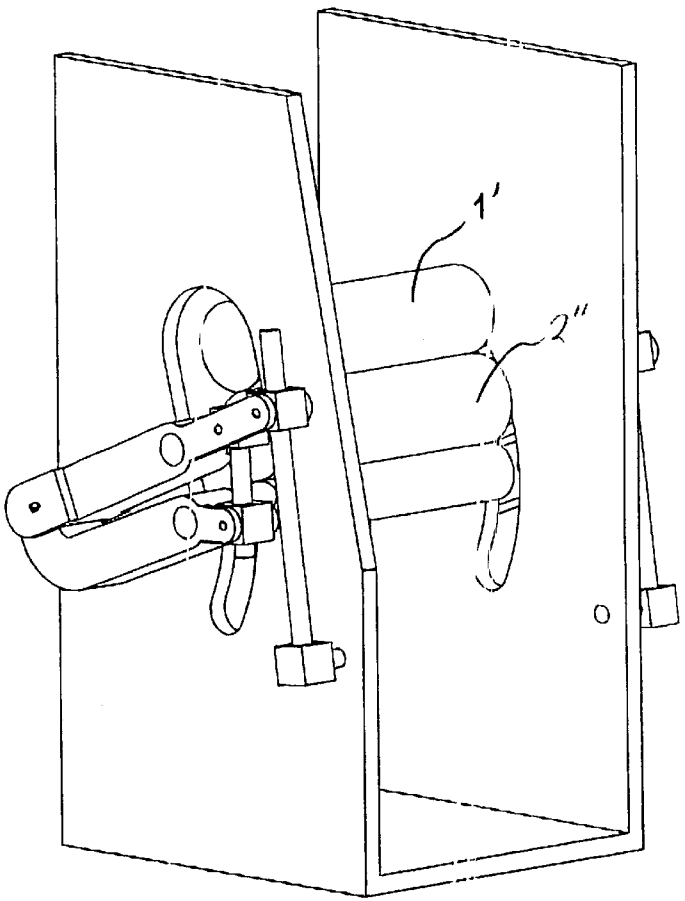
FIG. 2 is a view according to FIG. 1 in which a medium format of printing cylinders is supported.
Figure 3:
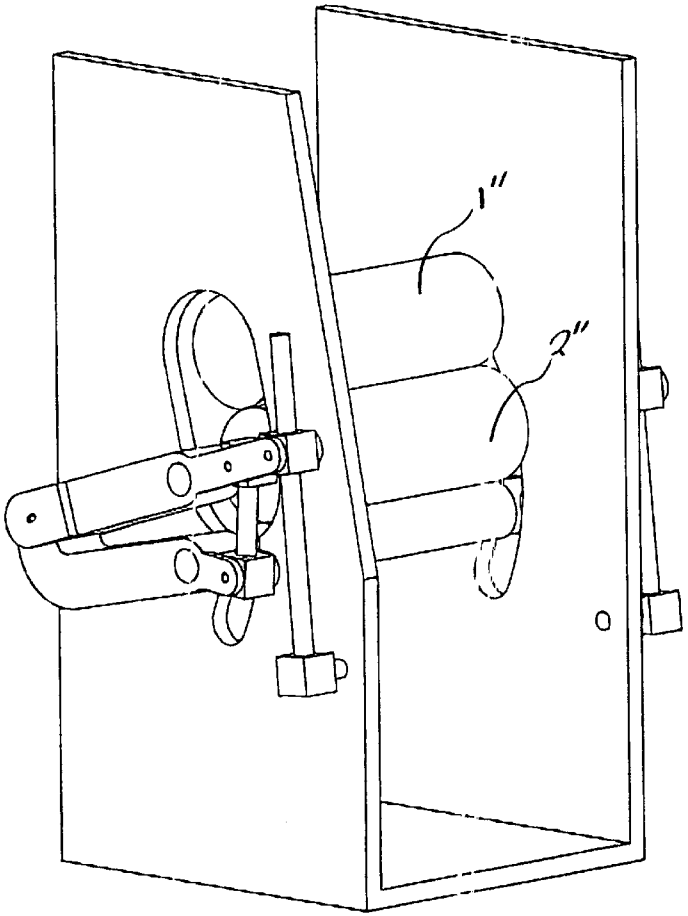
FIG. 3 is a view according to FIG. 1 in which a large format of printing cylinders is supported.

The main advantage of the construction described above can be seen in FIGS. 2 and 3, in which the bearing arms 8, 9 are rotated through predetermined angles to other desired positions in order to be able to support a medium format of image printing cylinder 1' and transfer printing cylinder 2' (FIG. 2), and large format image printing cylinder 1" and transfer printing cylinder 2" (FIG. 3) respectively.

Furthermore a suitable actuation of the actuating means 12, 13 makes it possible to accurately position the printing cylinders 1–3 with respect to each other such that the pressure on the contact area between the image printing cylinder 1 and transfer printing cylinder 2 is approximately equal to the pressure on the contact area between the transfer printing cylinder 2 and the impression printing cylinder 3. This makes it possible to achieve a very good printing quality for sheets to be printed which are guided between the transfer printing cylinder 2 and the impression cylinder 3, even when substrate having different thickness is being used.

During use the image printing cylinder 1 is provided with ink from an inking mechanism (not shown) positioned above the image printing cylinder 1. The inking mechanism is movably supported with respect to the image printing cylinder 1 in order to be able to ink different formats of image printing cylinders.

Figure 4:
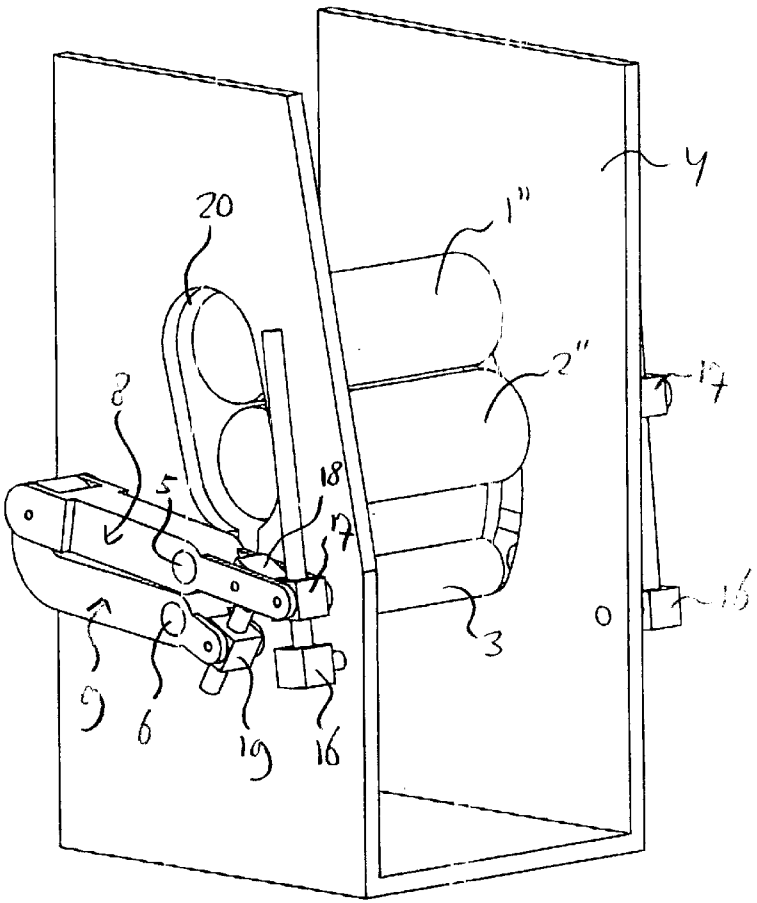
FIG. 4 is a view according to FIG. 3 in which the bearing arms on the left side are lowered to a replacement position.

In FIG. 4 the first and second bearing arms 8, 9 on the left side of the device and the second bearing arm 9 on the right side of the device are rotated to a lower replacing position, while the left supporting element 5 on the first bearing arm 8 is disconnected from the transfer printing cylinder 2". The impression printing cylinder 3 is moved along downwards together with its supporting elements 6 on the bearing arms 9. The bearing arm 8 on the right side is maintained in its upper supporting position and solely supports the transfer printing cylinder 2". The opening 20 in the left side wall of the supporting construction 4 is made large enough for the image printing cylinder 1" and the transfer printing cylinder 2" to be taken out of the device sideways. Thus it is easily possible to replace the format dependent printing cylinders for cylinders with the same or another format, by means of a separate actuating of the rotation of the bearing arms.

Figure 6:
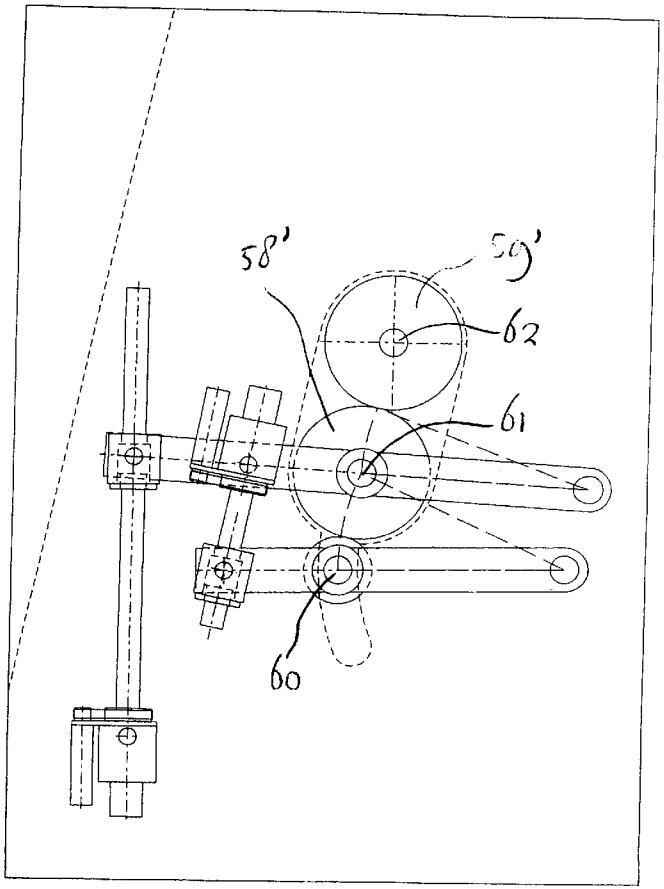
FIG. 6 is a view according to FIG. 5 in which a large format of printing cylinders is supported.
Figure 5:
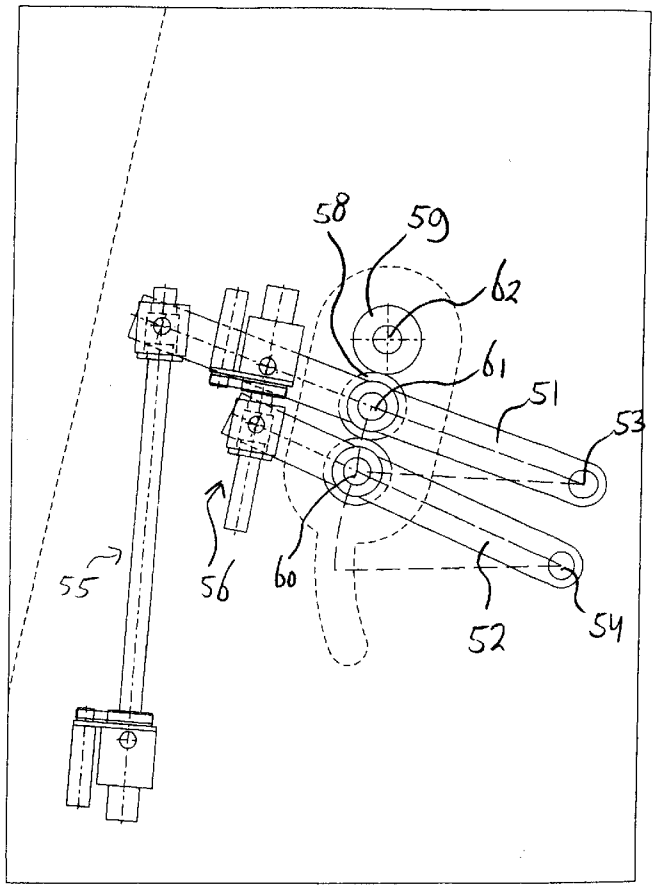
FIG. 5 shows a side view of a variant embodiment of the device in FIGS. 1–4.

FIGS. 5 and 6 show embodiments greatly similar to the embodiments shown in FIGS. 1–4, with the difference that first and second bearing arms 51, 52 are each rotatable about their own axis 53, 54 respectively. Here also first actuating means 55 for the first bearing arm 51 are indirectly connected to second actuating means 56 for the second bearing arm 52. In a variant not shown the actuating means may not be interconnected. FIG. 6 shows the device supporting a larger format of printing cylinders 58, 59. As can be seen best in FIGS. 5 and 6, the construction according to the invention makes it possible for the cylinders supported by their supporting elements to have their axes 60, 61, 62 lying approximately in line with respect to each other for both small and large format printing cylinders. With approximately in line here is meant the three axes 60, 61, 62 of the printing cylinders enclosing an angle in the range of 165–195°.

Figure 7:
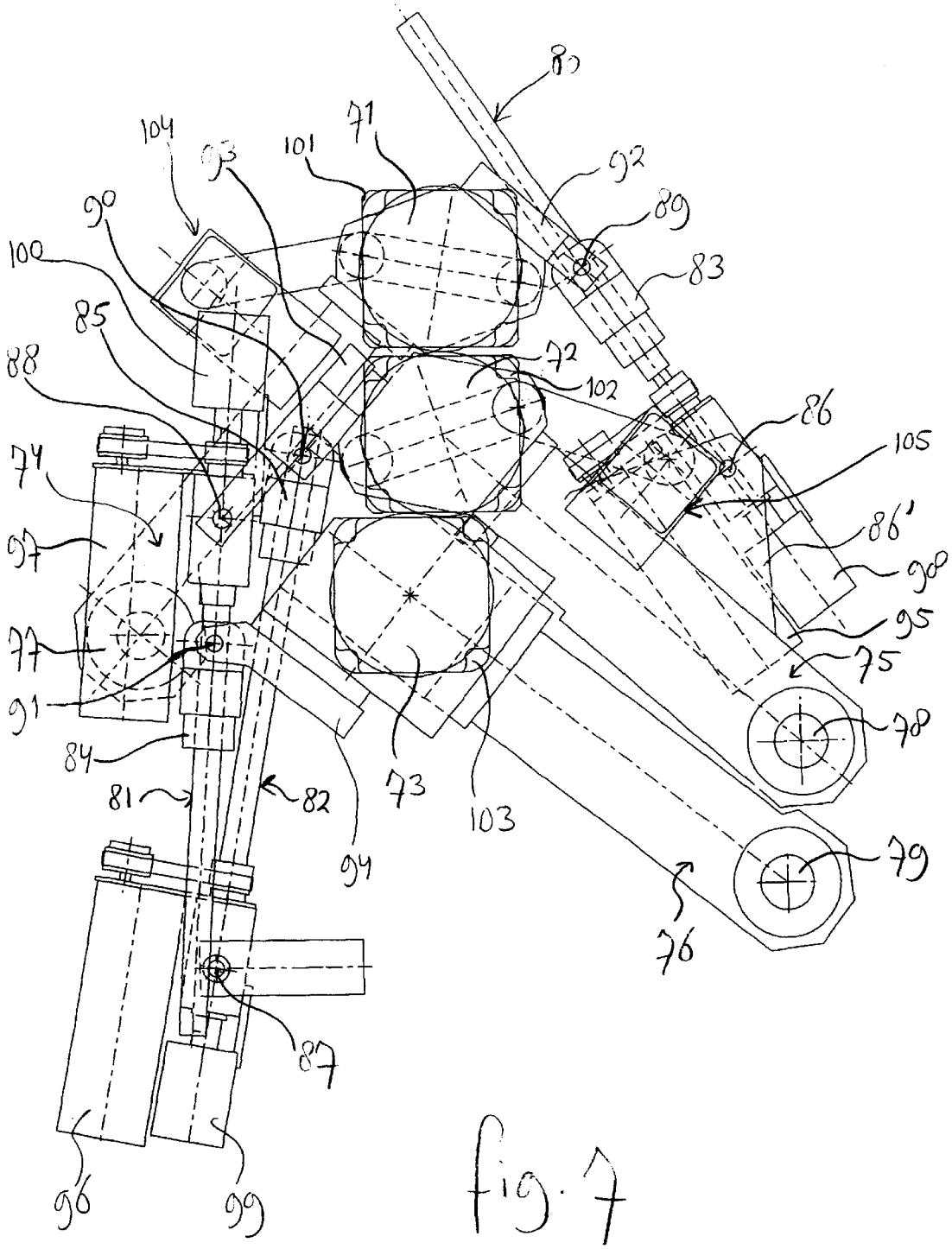
FIG. 7 shows diagrammatically an embodiment having three sets of co-operating bearing arms.

In FIG. 7 three printing cylinders 71, 72, 73, a plate cylinder, blanket cylinder and impression cylinder respectively, are fitted on the ends of the bearing arms 74, 75, 76. The printing cylinders 71, 72, 73 are supported on both sides by a bearing arm, the bearing arms being provided with supporting elements for accommodating a cylinder; see FIGS. 8 and 9 for this.

The bearing arms 74, 75, 76 are rotatable about the respective fixed centres of rotation 77, 78, 79. For rotation of the bearing arms 74, 75, 76, provision is made for ball circulation spindles 80, 81, 82, along which elements 83, 84, 85 can be moved by rotation. Spindle 82 is fitted on a fixed centre of rotation 87 and is further connected to a pivot point 90 provided on bearing arm 75, spindle 80 is connected by way of pivot point 86 and fixing plate 86' to bearing arm 75, and by way of pivot point 89 and fixing arm 92 to bearing arm 74, and spindle 81 is connected by way of pivot point 88 and fixing arm 93 to bearing arm 75 and by way of pivot point 91 and fixing arm 94 to bearing arm 76.

For the movement of the elements 83, 84, 85 along the spindles, the spindles are driven by motors 95, 96, 97, which act upon them by means of a toothed belt. Connected to the driven spindles are pulse generators 98, 99, 100, which indicate precisely the angular displacement. Such a pulse generator is, for example, subdivided into 1,024 steps per full revolution, an absolute pulse being generated after the passing through of each step. The position of the cylinders is in fact determined by these pulse generators.

The figure further shows the drive motors 101, 102, 103 for the respective cylinders 71, 72, 73 and the motors 104, 105, which are fitted on the bearing arms 74, 75 and by means of toothed belts act upon the means for permitting axial adjustment of the supporting elements provided in the bearing arms. The axial movement of the supporting elements serves to wedge the printing cylinder, and to permit axial movement of the printing cylinder.

Since in principle it is not format-dependent and therefore does not have to be changed, the impression cylinder 73 is fitted immovably between the bearing arms. For bringing the impression cylinder up to pressure and releasing it from pressure, use is made of the positioning means of the bearing arms, so that the usual eccentrics for the impression cylinders can be dispensed with here.

Furthermore, in the case of an impression cylinder the possibility for enabling axial movement of the cylinder is not necessary, so that there again no drive facility need be provided for it on the bearing arm. The possibility of axial displacement of the printing cylinders is intended for permitting positioning of the printed image correctly on the web, so that in principle an axial movement possibility for the plate cylinder alone would suffice.

Figure 8:
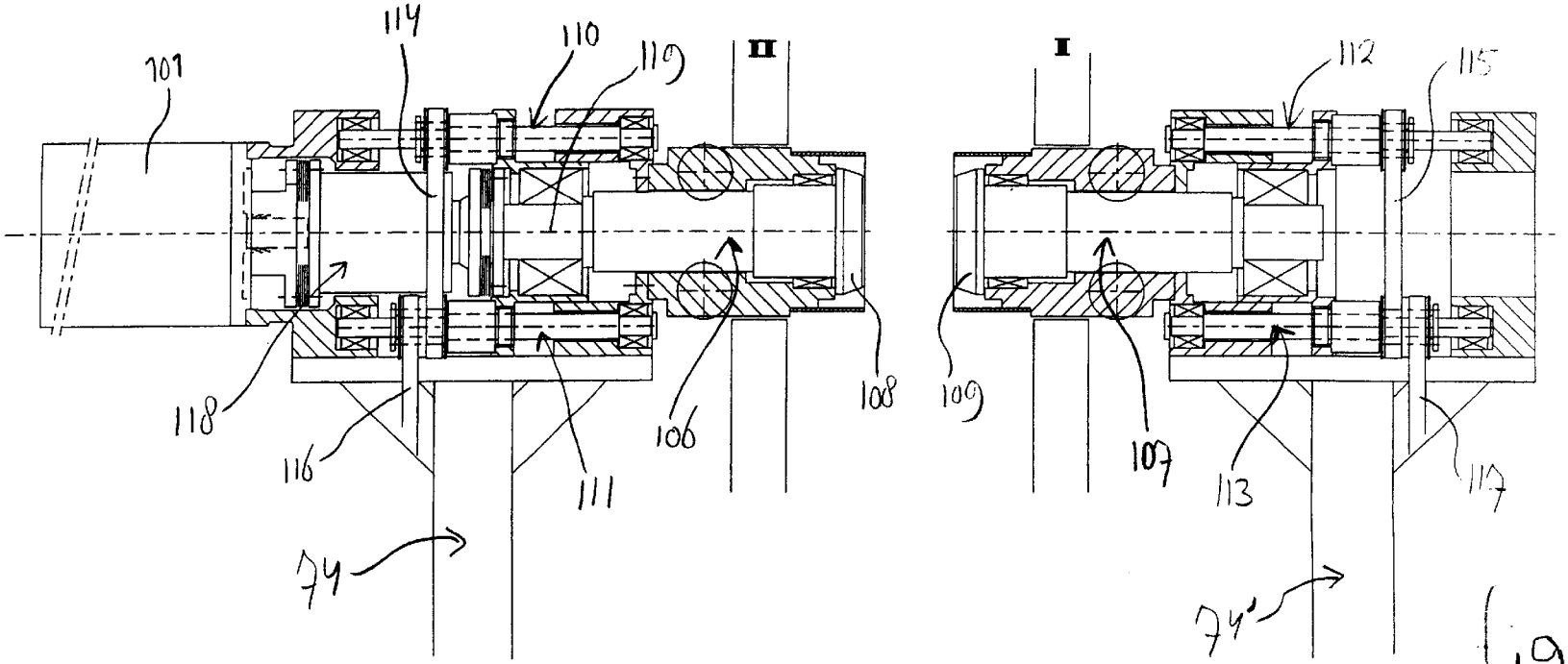
FIG. 8 shows an embodiment in which the positioning elements are two cones that are to be moved axially.

FIG. 8 shows a section through the bearing arms 74, 74' with drive motor 101 and supporting elements 106, 107. The supporting elements project through plate parts I and II of a frame and on the ends are provided with cones 108, 109, which are designed to fall into complementary parts of a cylinder and to wedge the cylinder. A register pin can also be fitted on one of the cones, being designed to fall into a slot of the cylinder, so that the cylinder always assumes a known position relative to the drive.

The supporting elements 106, 107 can be moved in the axial direction, both in opposite directions, in order to wedge a cylinder or undo the wedging, and in the same direction, in order to permit axial movement of the cylinder. To this end, provision is made for two screw spindles 110, 111 and 112, 113 per supporting element 106, 107, the screw spindles being interconnected by means of toothed belts 114, 115 and a further toothed belt 116, 117 running from one of the spindles to motors not shown in the figure. One of these motors 104 is shown in FIG. 7. Instead of a toothed belt 114 or 115, a gear wheel can also be used, which gear wheel acts upon gear wheels of a set of spindles 110, 111 or 112, 113.

The drive motor 101 is connected by way of a direct transmission 118 to a shaft part 119 of the supporting element 106.

Figure 9:
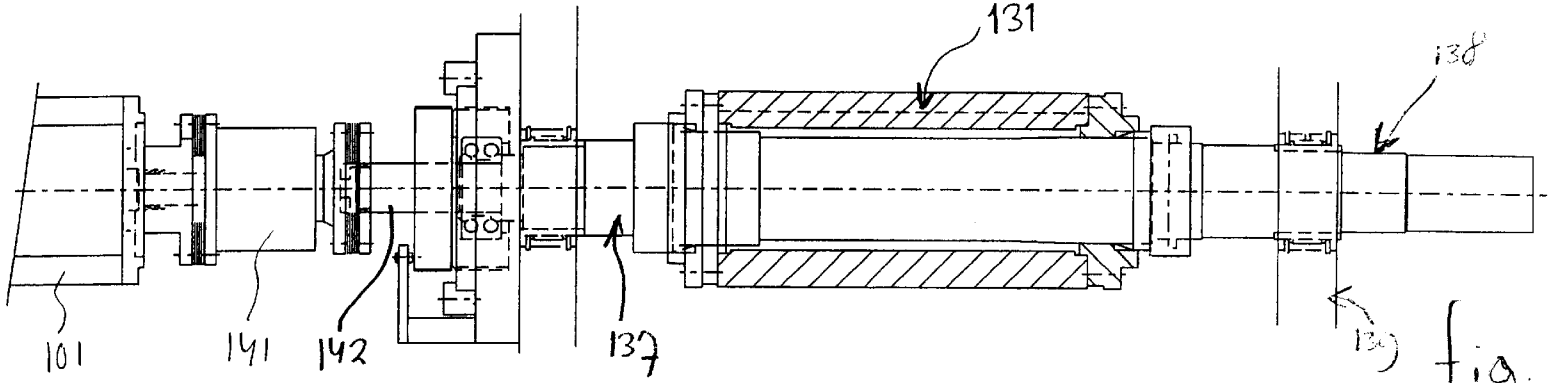
FIG. 9 shows the positioning element in the form of a through running mandrel with a clamping device.

Finally, FIG. 9 shows a section of a possible supporting element which is substantially composed of a through-running mandrel 137, over which a printing cylinder 131 is pushed and clamped there with the aid of a clamping device 138. The clamping device 138 is supported in a part 139 of a housing which is fitted in a sprinting tower, and which can be removed or folded away together with the clamping device 138, with the result that sufficient space is produced to permit removal of a cylinder from the mandrel 137 or sliding of a cylinder onto the mandrel in the axial direction.

On the drive side, drive motor 101 is connected by way of a spline shaft 141 to the shaft 142 of the mandrel 137, provision further being made for a drive mechanism 140 for permitting adjustment of the mandrel 137 in the axial direction. Instead of a spline shaft, it is also possible, for example, to provide an axially adjustable coupling or a combination of two fixed gear wheels.

Besides the embodiments shown numerous variants are possible. For example a printing assembly having four printing cylinders may be provided for double sided printing of sheets, that is to say two image printing cylinders and two transfer printing cylinders. With this supporting elements for at least three of the cylinders are provided on first, second and third bearing arms each rotatable about an axis, the positioning means comprising first, second and third actuating means for rotating each respective bearing arm and supporting element through predetermined angles. Furthermore, the actuating means may also be formed by a worm-gear mechanism connected to the bearing arm. Instead of bearing arms on both sides of the printing cylinders, it is also possible to provide bearing arms on only one side of the printing cylinders.

Thus the device according to the invention makes it possible to provide for a quick and easy adjustment of an offset printing press for printing different formats of substrate, and/or for printing different substrate thickness. The at least two sets of bearing arms make it possible to accurately position the printing cylinders with respect to each other, resulting in a superb printing quality.

What is claimed is:

1. Device for use in an offset printing press for supporting and positioning of printing cylinders of the printing press exchangeably therein, the printing press or one or more component modules thereof being provided with a printing assembly having at least three printing cylinders, and a drive being provided for said cylinders, said device being provided with supporting elements for exchangeably supporting at least two of said cylinders, and positioning means for positioning at least two of said cylinders, wherein at least one of said supporting elements for said at least two cylinders is provided on at least one of first and second bearing arms each rotatable about an axis, said positioning means comprising first and second actuating means for rotating of each respective bearing arm and supporting element through predetermined angles, with the result that at least two cylinders can be exchanged for cylinders of the same or another format, in which said actuating means for at least one bearing arm comprises an adjustable distance device whose component parts are pivotably connected to this bearing arm and to a fixed point or other bearing arm respectively, in which said adjustable distance device is a screw spindle, in which a detection device is provided for detection of an angle of rotation of a drive shaft or driven element on said screw spindle.

2. Device according to claim 1, in which three supporting elements are provided for supporting three printing cylinders, one supporting element of which is in a fixed position.

3. Device according to claim 2, in which said three printing cylinders are an image printing cylinder, a transfer printing cylinder and an impression printing cylinder, of which said image printing cylinder is in a fixed position.

4. Device according to claim 1, in which at least one supporting element is axially movable, a movement of this supporting element being possible by means of a drive fitted on a bearing arm or supporting member.

5. Device according to claim 1 in which a supporting element is substantially composed of a mandrel provided with a clamping device for clamping a printing cylinder on said mandrel.

6. Device according to claim 1, in which for synchronous running of said printing cylinders provision is made for a fixed action point between a supporting element and a printing cylinder.

7. Device according to claim 1, in which said supporting elements are positionable with respect to each other such that said axes thereof are approximately in line.

8. Device according to claim 1, in which for each of said at least two cylinders to be supported by bearing arms, a set of opposite bearing arms is provided, each bearing arm being provided with a supporting element.

9. Device according to claim 8, in which said bearing arms of said same set are separately rotatable.

10. Device according to claim 1, wherein at least two drive motors are provided for the purpose of rotation of at least two of said printing cylinders about their own axes during printing.

11. Device according to claim 1, in which said first actuating means are rotatably connected to a fixed point and said first bearing arm, and said second actuating means are rotatably connected to said first bearing arm and said second bearing arm.

12. Device for use in an offset printing process for supporting and positioning of printing cylinders of the printing press exchangeably therein, the printing press or one or more component modules thereof being provided with a printing assembly having at least three printing cylinders, and a drive being provided for said cylinders, said device being provided with supporting elements for exchangeably supporting at least two of said cylinders, said supporting elements and said at least two cylinders being movable with respect to each other in the axial direction for permitting an exchangeable support, and positioning means for positioning at least two of said cylinders, wherein at least one of said supporting elements for said at least two cylinders is provided on at least one of first and second bearing arms each rotatable about an axis, said positioning means comprising first and second activating means for rotating of each respective bearing arm and supporting element through predetermined angles, with the result that at least two cylinders can be exchanged for cylinders of the same or another format, wherein at least two drive motors are provided for the purpose of rotation of at least two of said printing cylinders about their own axes during printing.

13. Device according to claim 12, in which three supporting elements are provided for supporting three printing cylinders, one supporting element of which is in a fixed position.

14. Device according to claim 13, in which said three printing cylinders are an image printing cylinder, a transfer printing cylinder and an impression printing cylinder, of which said image printing cylinder is in a fixed position.

15. Device according to claim 12, in which at least one supporting element is axially movable, a movement of this supporting element being possible by means of a drive fitted on a bearing arm or supporting member.

16. Device according to claim 12, in which a supporting element is substantially composed of a mandrel provided with a clamping device for clamping a printing cylinder on said mandrel.

17. Device according to claim 12, in which for synchronous running of said printing cylinders provision is made for a fixed action point between a supporting element and a printing cylinder.

18. Device according to claim 12, in which said supporting elements are positionable with respect to each other such that said axes thereof are approximately in line.

19. Device according to claim 12, in which for each of said at least two cylinders to be supported by bearing arms, a set of opposite bearing arms is provided, each bearing arm being provided with a supporting element.

20. Device according to claim 19, in which said bearing arms of said same set are separately rotatable.

21. Device according to claim 12, in which said first actuating means are rotatably connected to a fixed point and said first bearing arms, and said second actuating means are rotatably connected to said first bearing arm and said second bearing arm.

22. Device according to claim 12, in which said actuating means for at least one bearing arm comprises an adjustable distance device whose component parts are pivotably connected to this bearing arm and to a fixed point or other bearing arm respectively.

23. Device according to claim 22, in which said adjustable distance device is a screw spindle.

* * * * *